US007890002B2

(12) United States Patent
Kimura et al.

(10) Patent No.: US 7,890,002 B2
(45) Date of Patent: Feb. 15, 2011

(54) IMAGE FORMING APPARATUS WITH COOLING DEVICE AND CONTROLLER PERMITTING IMAGE HEATING DURING ERROR OCCURRENCE

(75) Inventors: Kuniyasu Kimura, Toride (JP); Takahiko Yamaoka, Kashiwa (JP); Yuichi Yamamoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 843 days.

(21) Appl. No.: 11/765,037

(22) Filed: Jun. 19, 2007

(65) Prior Publication Data

US 2008/0013981 A1 Jan. 17, 2008

(30) Foreign Application Priority Data

Jul. 3, 2006 (JP) ..... 2006-182960
Jul. 3, 2006 (JP) ..... 2006-183953

(51) Int. Cl.
*G03G 15/02* (2006.01)
*G03G 15/20* (2006.01)

(52) U.S. Cl. ..... 399/31; 399/69

(58) Field of Classification Search ..... 399/31, 399/33, 67–70

See application file for complete search history.

(56) References Cited

U.S. PATENT DOCUMENTS

2007/0059022 A1 3/2007 Yamaoka et al. ..... 399/92
2007/0086803 A1 4/2007 Kimura et al. ..... 399/69

FOREIGN PATENT DOCUMENTS

| | | | |
|---|---|---|---|
| JP | 60-136779 | | 7/1985 |
| JP | 5-181382 | | 7/1993 |
| JP | 2000172131 A | * | 6/2000 |
| JP | 2003-076209 | | 3/2003 |

* cited by examiner

*Primary Examiner*—David M Gray
*Assistant Examiner*—Gregory H Curran
(74) *Attorney, Agent, or Firm*—Fitzpatrick, Cella, Harper & Scinto

(57) ABSTRACT

There is provided an image forming apparatus that effectively suppresses an increase in temperature of a heating device by operating an air blowing device when image formation is performed to a small-size recording material, and which can continuously perform the image formation. The image forming apparatus includes a heating device to heat a recording material to be conveyed, a cooling fan that blows air from an air blowing port facing a part of the heating device, and a shutter that moves such that an opening width of the air blowing port is regulated depending on a width of the recording material. The image forming apparatus also includes an error detecting device that detects an error of the cooling fan. When the error detecting device detects an error of the cooling fan, the shutter moves to a position such that image formation is continued.

18 Claims, 14 Drawing Sheets

IMAGE FORMING APPARATUS WITH COOLING DEVICE AND CONTROLLER PERMITTING IMAGE HEATING DURING ERROR OCCURRENCE

BACKGROUND OF THE INVENTION

1. Field of the Invention

The present invention relates to an image forming apparatus using an electrophotographic system and, more particularly, to an image forming apparatus such as a copying machine, a printer, or a facsimile.

2. Description of the Related Art

In a conventional technique, after a toner image is formed on a recording material (to be referred to as a sheet hereinafter) by a method called a Carlson process, the toner image is fixed as a permanent image.

As the fixing system, a system which causes a sheet to pass through a portion between a fixing member and a pressure member to heat, press, and fix a toner image is popularly employed.

A fixing device which employs the system is required to cope with a large sheet having a relatively wide size such as an A3 size to a small sheet having a relatively narrow size such as an A4R size.

However, when a fixing process is continuously performed to a small-size sheet, since a sheet does not remove heat from a region (to be also referred to as a non-passing paper portion) of the fixing member on an end side which is not in contact with the sheet, the region may be overheated. In this state, when the fixing process is continuously performed on a large-size sheet, a toner image on an end of the sheet in the width direction cannot be excellently fixed. Therefore, in the fixing device described in Japanese Patent Application Laid-Open No. 2003-76209, a cooling device which cools the non-passing paper portion by spraying air with a fan is arranged. In the fixing device, since the region of the non-paper-passing portion changes depending on a width of a sheet to be used, a region to be cooled with a fan is changed by a shutter. However, in the fixing device described in Japanese Patent Application Laid-Open No. 2003-76209, no countermeasures to be employed in case of failure of the cooling device constituted by the fan and the shutter are presented. Therefore, in case of failure of the cooling device, when a countermeasure which immediately inhibits image formation is employed, the following problem may be posed. Although most of the fixing device except for a part of the cooling device can normally operate, a user must wait image formation until a service person completes repair of the cooling device. This state is very inconvenient to a user who wants to immediately form an image. The countermeasure which immediately inhibits image formation spoils usability and is not a desirable countermeasure.

SUMMARY OF THE INVENTION

The present invention provides an image forming apparatus which can suppress deterioration of usability. Another object of the present invention will be apparent by reading the following detailed description with reference to the accompanying drawings. In a typical configuration in the present invention, an image forming apparatus comprises: an image forming device which forms a toner image to a recording material; an image heating device which heats the toner image on the recording material; a cooling device which cools said image heating device by blowing an air; a controller which permits execution of the image heating process after an error occurs in said cooling device.

DESCRIPTION OF THE EMBODIMENTS

An image forming apparatus according to an embodiment of the present invention will be described below with reference to the accompanying drawings.

First Embodiment

Figure 1:
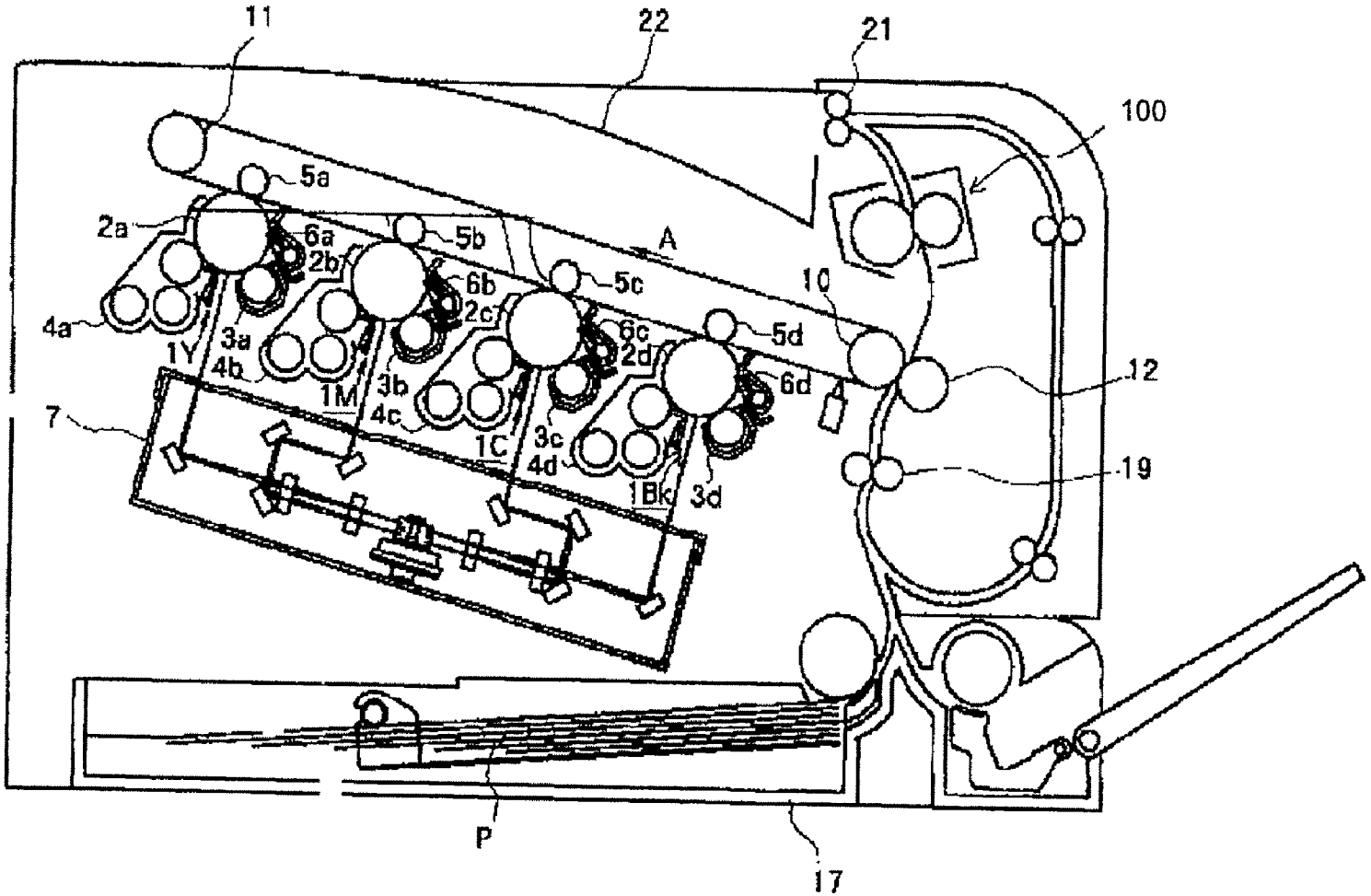
FIG. 1 is a side sectional view of an image forming apparatus according to an embodiment.

FIG. 1 is a sectional view for describing an entire configuration of the image forming apparatus according to a first embodiment. The image forming apparatus according to the embodiment is a color image forming apparatus which forms a full-color image by using toners of four colors, i.e., yellow, magenta, cyan, and black.

{Entire Configuration of Image Forming Apparatus} The image forming apparatus according to the embodiment includes, as two main constituent elements, an image forming device to form a toner image on a sheet serving as a recording material and an image heating device to heat the toner image formed on the sheet. The image forming device according to the embodiment includes, as two main constituent elements, a plurality of image forming portions to form a color image and a transfer device (intermediate transfer member or the like (will be described later)) to transfer toner images formed by the image forming portions to a recording member. An image heating device according to the embodiment will be described below by using a fixing device as an example. The image forming apparatus according to the embodiment includes four image forming portions and an intermediate transfer member (intermediate transfer belt). Single-color images formed in the image forming portions are superposed on the intermediate transfer belt to primarily transfer the images, and the images are secondarily transferred to a recording material to obtain a color image.

More specifically, the image forming apparatus according to the embodiment, as shown in FIG. 1, includes an image forming portion 1Y which forms a yellow-color image, an image forming portion 1M which forms a magenta-color image, an image forming portion 1C which forms a cyan-color image, and an image forming portion 1Bk which forms a black-color image. The four image forming portions 1 (1Y, 1M, 1C, and 1Bk) are arranged in a line at predetermined intervals.

The image forming portions 1 have the same configurations except for the colors of toners to be developed. In the image forming portions 1, drum type electrophotographic photosensitive members (to be referred to as "photosensitive drums" hereinafter) 2 (2*a*, 2*b*, 2*c*, and 2*d*) are arranged as image bearing members. Around the photosensitive drums 2, primary chargers 3 (3*a*, 3*b*, 3*c*, and 3*d*), developing devices 4 (4*a*, 4*b*, 4*c*, and 4*d*), transfer rollers 5 (5*a*, 5*b*, 5*c*, and 5*d*) serving as transfer means, and drum cleaners 6 (6*a*, 6*b*, 6*c*, and 6*d*) are arranged, respectively. Below a portion between the primary charger 3 and the developing device 4, a exposing device 7 is installed.

Above the photosensitive drums 2, an intermediate transfer belt 8 is tightened between a secondary transfer counter roller 10 and a tension roller 11 and can be rotated in a direction given by an arrow A in image formation.

In the image formation, a surface of the rotating photosensitive drums 2 is electrically charged by the primary chargers 3, and exposure depending on image signals is performed by the exposing device 7 to form electrostatic latent images. The electrostatic latent images are developed by the developing devices 4, and the toner images are sequentially superposed by colors on the intermediate transfer belt 8 rotated by applying a bias to the transfer rollers 5, and the images are primarily transferred to form a color image.

In synchronism with the image forming operation, a recording material P is conveyed from a cassette 17 loaded onto a lower portion of the apparatus main body to a secondary transfer portion serving as a nip portion between a secondary transfer roller 12 and the intermediate transfer belt 8 by a conveyance roller 19 or the like. At the secondary transfer portion, the toner image on the intermediate transfer belt 8 is secondarily transferred onto the recording material P by applying a bias to the secondary transfer roller 12, and the recording material P is conveyed to a fixing device 100 located above.

The recording material P conveyed to the fixing device 100 is applied with heat and pressure to thermally fix the toner image. Thereafter, the recording material P is discharged to a discharge portion 22 by a discharge roller 21 to complete a series of image forming operations.

Figure 2:
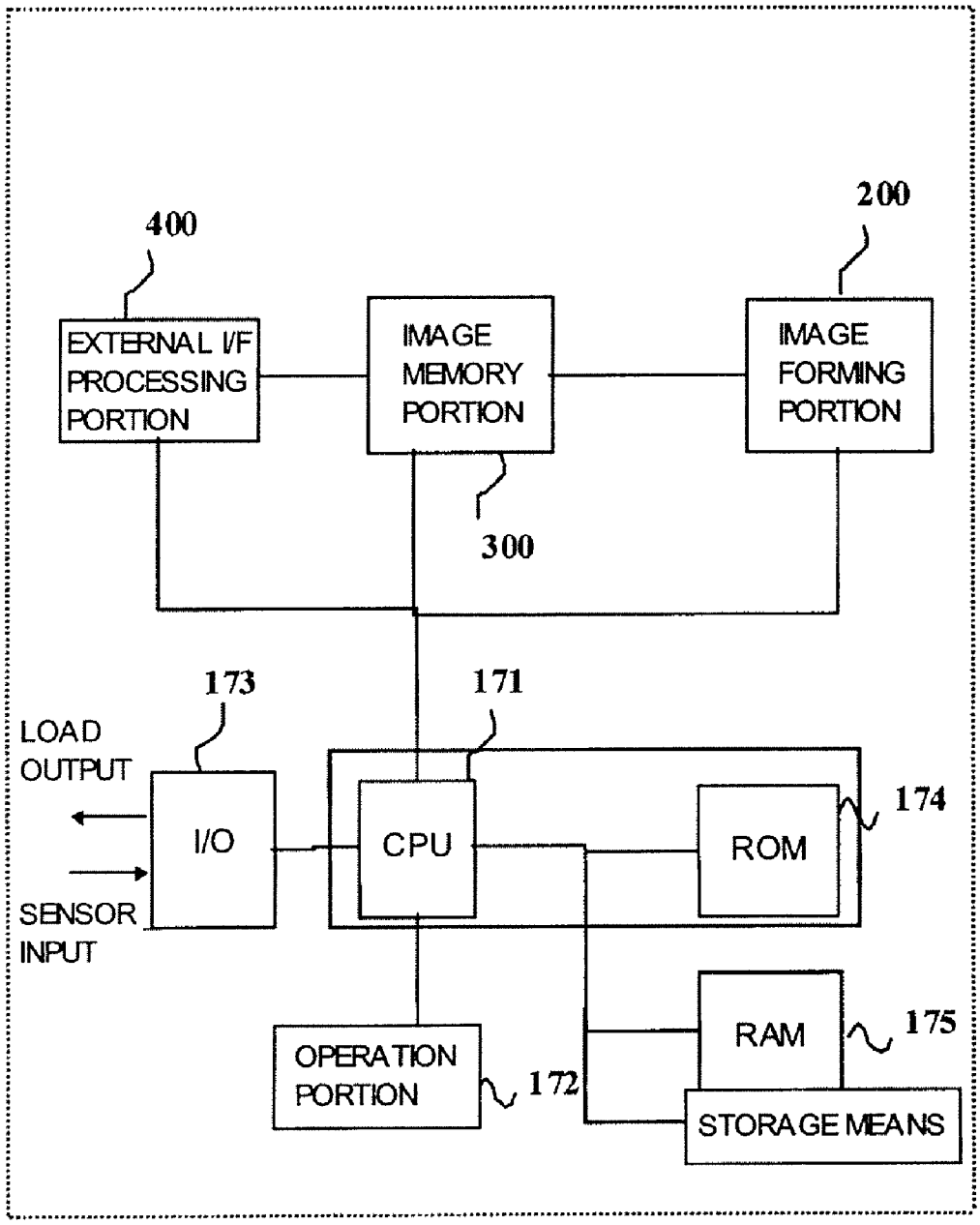
FIG. 2 is a control block diagram in the image forming apparatus according to the embodiment.

FIG. 2 is a control block diagram showing a configuration of a control portion in the image forming apparatus. A CPU 171 constitutes a control means which perform basic control of the image forming apparatus. A ROM 174 in which a control program is written, a work RAM 175 to perform processing, and an input/output port 173 are connected to the CPU 171 by an address bus and a data bus.

To the CPU 171, an external I/F processing portion 400 which transmits and receives image data and processing data from an external device such as a PC, an image memory portion 300 which performs an extending process of an image and temporarily performs an accumulating process, and an image forming portion 200 which performs processing to expose line image data transferred from the image memory portion 300 to the exposing device 7 are connected. Furthermore, an operation portion 172 is connected to the CPU 171 to control a display portion of the operation portion 172 and a key input means.

Inputs (not shown) of various loads (not shown) such as a motor and a clutch which control the image forming apparatus and sensors which detect positions of a recording material are also connected to the input/output port 173. To the input/output port 173, a fan constituting an air blowing means (will be described later), an error detecting means which detects an error such as a stop of the fan, a temperature detecting sensor which detects a temperature of the fixing device, and the like are connected.

Figure 3:
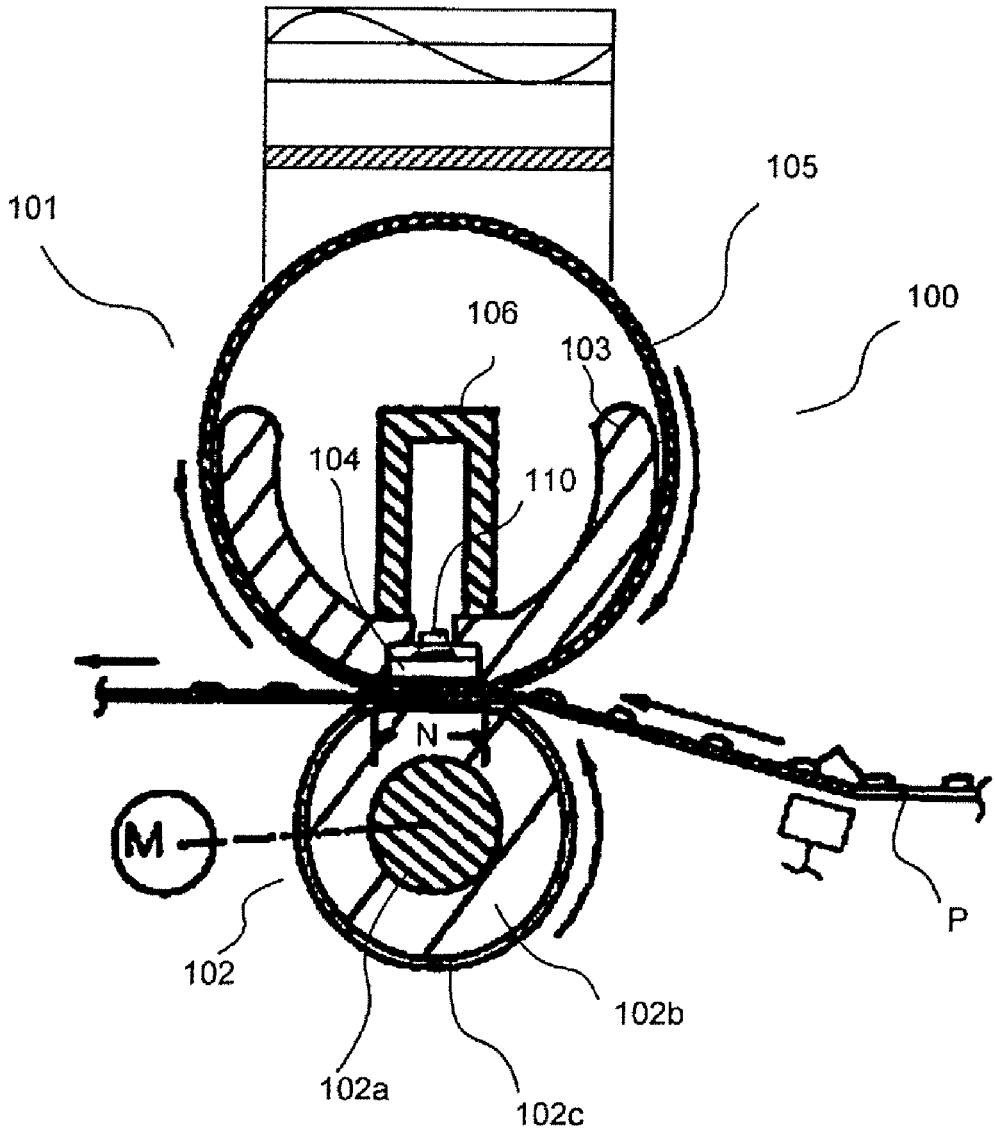
FIG. 3 is a diagram of a configuration of a fixing device according to the embodiment.

{Fixing Device} The fixing device 100 serving as an image heating device according to the embodiment will be described below. FIG. 3 is a side sectional view of the fixing device 100 in this embodiment. The fixing device 100 according to the embodiment is an on-demand fixing device using a cylindrical film as an image heating member. This film is designed to be rotated by a pressure roller.

In the fixing device 100 according to the embodiment, as shown in FIG. 3, a film assembly 101 constituting an image heating device and an elastic pressure roller 102 serving as a pressure member are brought into press contact with each other to form a fixing nip portion N. When the recording material P passes through the fixing nip portion N, heat and pressure are applied to the recording material P.

In the film assembly 101, a ceramic heater 104 is arranged on a lower surface of a heat-resistive rigid film guide member 103 having a semicircular-arc-watershoot-like transverse section such that the heater 104 is fitted and fixed in a recessed groove portion arranged along the longitudinal direction of the film guide member 103. A heat-resistive fixing film 105 is loosely and externally fitted in the film guide member 103 to which the heater 104 is fixed, and a pressure rigidity stay 106 is inserted into the film guide member 103.

On the other hand, the pressure roller 102 is obtained by attaching an elastic layer 102*b* such as silicon rubber to a cored bar 102*a* to decrease the hardness of the cored bar 102*a*. In order to improve surface nature, a fluorocarbon resin layer 102*c* such as PTFE, PFA, or FEP may be formed on the circumference of the pressure roller 102. The pressure roller 102 is arranged such that both the ends of the cored bar 102*a* are rotatably held between side plates on the front side and the rear side of an apparatus chassis (not shown) through bearing members.

In fixing, rotation of the pressure roller 102 is started on the basis of a print start signal, and heating up of the heater 104 is started. In the heating up of the heater 104, power is supplied from a power supply (not shown) to an energization heat generating layer of the heater 104 to cause the energization heat generating layer to generate heat, so that the heater 104 rapidly increases in heat. The CPU 171 controls energization to the energization heat generating layer such that a heater temperature detected by a temperature sensor 110 such as a thermistor arranged in contact with the heater 104 is kept at a predetermined almost constant temperature (fixing temperature. More specifically, the heater 104 is heated to the predetermined fixing temperature and controlled in temperature.

{Cooling Mechanism of Fixing Device} A cooling mechanism serving as a cooling device of the fixing device according to the present invention will be described below. In the fixing device 100, a recording material having a maximum size used in image formation can be nipped, heated, and pressured. For this reason, when a recording material having a size smaller than the maximum size passes through the fixing device 100, the temperature of a non-paper-passing region increases more easily than a paper-passing region because heat of the non-paper-passing region is not removed by the recording material P. Therefore, when an image is to be formed on a recording material having a small size in the fixing device 100, the surface portion of the non-paper-passing region which is a surface portion of the fixing film 105 which passes through the non-paper-passing region is cooled depending on a temperature detected by the temperature sensor 110.

Figure 4:
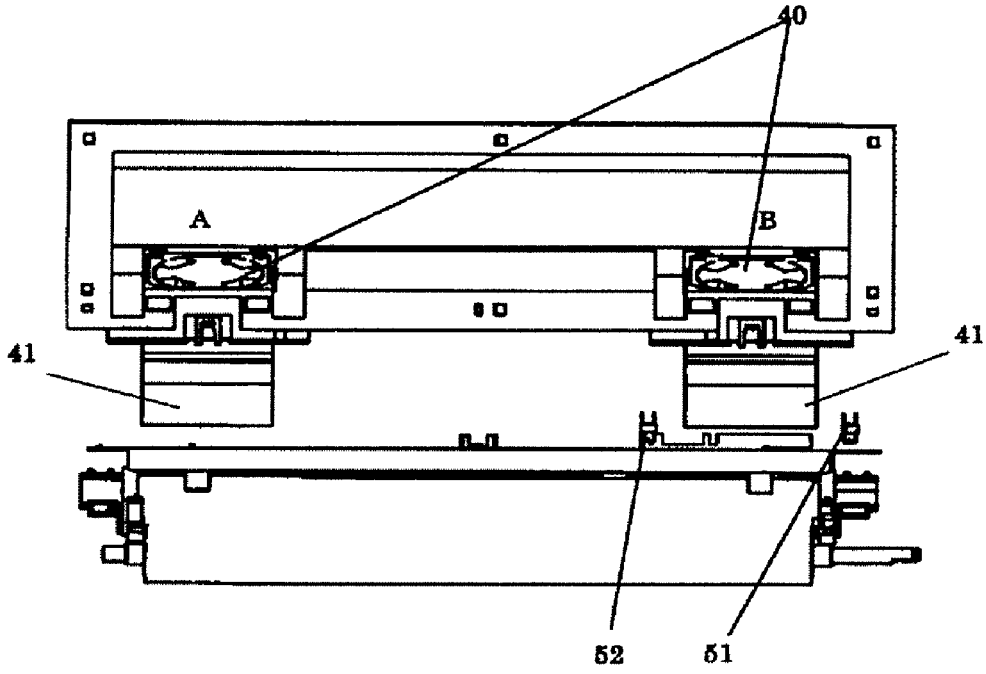
FIG. 4 is a top view of the fixing device according to the embodiment.

For this purpose, an air blowing device (fan) which blows air toward an air blowing port is formed in the fixing device 100 according to the embodiment to cool the image heating means. More specifically, as shown in FIG. 4, a cooling duct 41 in a non-paper-passing region in which an air blowing port 43 (FIG. 5) formed to face a non-paper-passing-area-passing surface serving as a part of a recording-material-passing surface of the fixing film 105 is arranged, and a cooling fan 40 is arranged in the cooling duct 41 to obtain a cooling device.

In this case, the paper-passing region and the non-paper-passing region used in the description are as follows. When a small-size recording material (in the embodiment, for example, a post card or the like) having a size in width direction smaller than that of a recording material (in the embodiment, A3 paper) having a maximum width which can be used in the image forming apparatus passes through a fixing nip region, a fixing region through which the small-size recording material passes is called a paper-passing region (contact region). A region which is closer to the end side of the fixing film in the width direction than the paper-passing region is called a non-paper-passing region.

In the embodiment, since the recording material is conveyed with reference to a center of the fixing film in the width direction, non-paper-passing regions are formed on both the sides of the recording material in the width direction. For this reason, as shown in FIG. 4, the cooling fans 40, the cooling ducts 41, and shielding plates (shutters) 42 are arranged on both the sides (A and B) of the recording material in the width direction.

Figure 5:
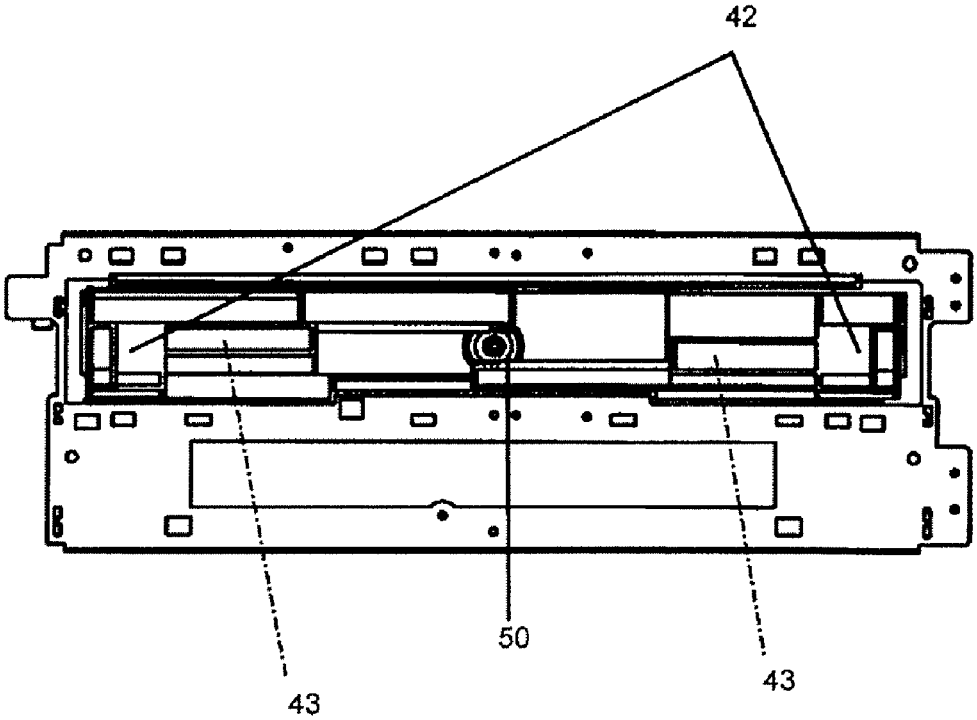
FIG. 5 is a front view of a shutter and an opening adjusting member.

Furthermore, in the cooling device according to the embodiment, the shutter 42 serving as regulating member which regulates an opening width of the air blowing port 43 depending on the width of the recording material is arranged. The shutter 42, as shown in FIG. 5, can shield the air blowing port 43 formed at the end of the cooling duct 41. When one gear 50 serving as a drive device interlocked with the right and left shutters 42 is rotated, the right and left shutters 42 symmetrically move to adjust the opening widths of the air blowing ports 43 depending on the width of the recording material.

For this reason, in execution of cooling control, the shutters 42 are moved to make it possible to adjust a width of a region which blows air to the non-paper-passing region to an optimum width.

Furthermore, in order to adjust the opening widths of the shutters 42 depending on a plurality of small-size recording materials, as shown in FIG. 4, a sensor 51 which detects a home position of the shutters 42 and an opening width detecting sensor 52 which adjusts an opening width to a predetermined size are arranged. In this manner, the shutters 42 is moved in accordance with the size of the recording material to adjust the opening width of the air blowing port, and air is blown to the non-paper-passing region of the heated fixing film 105 to effectively suppress an increase in temperature of the corresponding portion.

The cooling fan 40 which blows cooling air has the CPU 171 (FIG. 2) serving as a controller which turns on/off the cooling fan 40 at a predetermined timing by using a temperature detection result of the non-paper-passing region. Furthermore, the shutter 42 moves a region to which cooling air is blown such that the width of the region is adjusted to an optimum opening width depending on the width of the small-size recording material. For this reason, an increase in temperature of the cooling fan 40 is suppressed. Therefore, overheat can be efficiently prevented at a low cost/in a small space without using a heat-resistant cooling fan.

In this case, in the cooling device described above, when the cooling fan 40 is broken down, an image forming operation may be stopped because cooling control is normally performed. However, in terms of usability, it is desired that even though the cooling fan 40 is broken down, an image forming operation (image heating process by an image heating device) is continued as long as the image forming apparatus is not adversely affected.

Therefore, in the cooling device according to the embodiment, when the cooling fan 40 is broken down, the CPU 171 allows the subsequent image forming process (image heating process) without inhibiting the process. The CPU 171 makes a countermeasure to prevent adverse affect to other portions of the apparatus.

Figure 6:
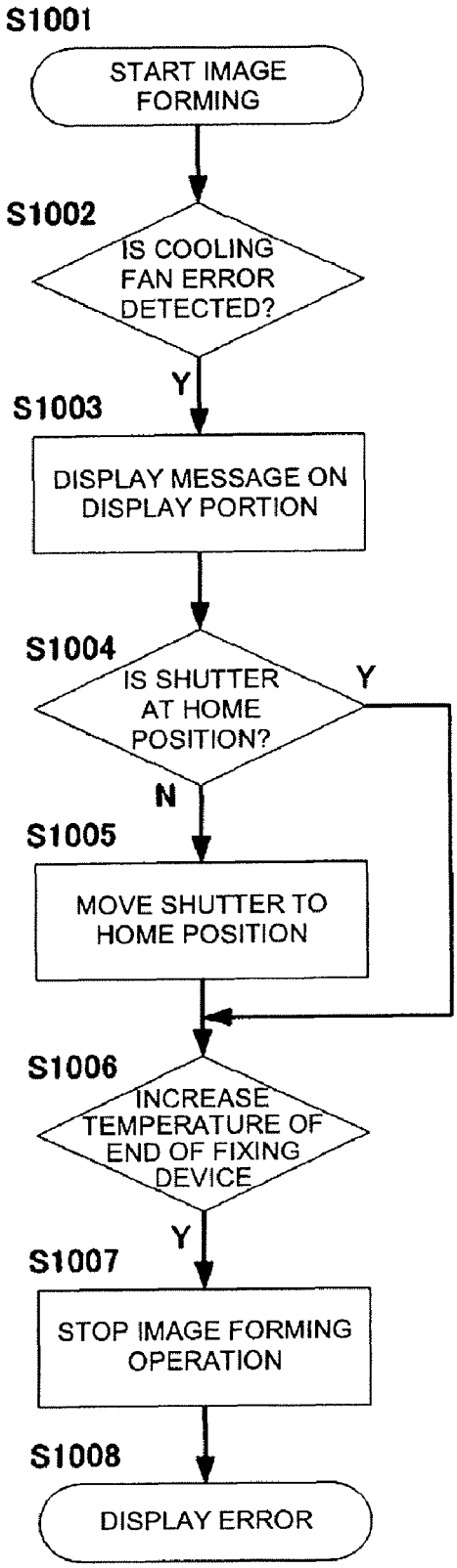
FIG. 6 is a flow chart applied when a cooling fan error occurs.

More specifically, in the cooling device according to the embodiment, as shown in a flow chart in FIG. 6, when a cooling fan motor which drives the cooling fan 40 is normally driven, a lock signal of the cooling fan motor is set at high. The CPU 171 monitors a status of the lock signal through the input/output port 173 to detect an error of the cooling fan 40. As an error of the cooling fan 40 according to the embodiment, a case in which the lock signal of the cooling fan motor cannot be detected for a predetermined period of time is supposed. In this manner, an error of the air blowing means is detected by the error detecting means.

When the cooling fan 40 normally functions, when printing of a small-size recording material is performed, or when a detected temperature obtained by a thermistor exceeds a predetermined temperature, the shutter 42 is moved to a predetermined position to adjust a cooling range.

When an error occurs in the cooling fan 40 (S1002), an operator must be notified that the error occurs in the cooling apparatus. For this reason, an error notification signal is output from an output means to display an alarm indication on a display portion serving as a notification device arranged on the operation portion (S1003). As the alarm indication used in this case, for example, it is displayed that productivity may be deteriorated due to a failure occurring in the fixing device. A sentence to be displayed is not limited to the above sentence. For example, any sentence which can notify an operator that a failure occurs in the fixing device may be used.

It is determined whether the shutter 42 is at a position at which the cooling fan 40 is shielded (S1004). In the embodiment, when the shutter 42 is at a home position, the air blowing port 43 is closed by the shutter 42, or the cooling fan 40 is not heated by the fixing film. Therefore, when the position of the shutter 42 is the home position, the image forming operation is continued without being changed. when the shutter 42 is not at the home position, the shutter 42 moves to the home position (S1005).

When the shutter 42 is moved to the home position, the fixing device is less affected by the cooling fan 40. For this reason, the image formation can be continued regardless of an operation error of the cooling fan 40.

In the above state, a continuous printing operation or the like of the small-size recording material is continued. When the non-paper-passing portion is heated to a set temperature or higher (S1006), the image formation is interrupted (S1007), and an error is displayed on the display portion arranged on the operation portion (S1008).

The interruption of the image formation is determined by an increase in temperature of the non-paper-passing portion in the case described above. However, the image forming operation may be forcibly stopped when an operation error of the cooling fan 40 is detected, after the image formation is allowed (continued) until a predetermined number of recording materials pass or predetermined time passes.

Second Embodiment

An image forming apparatus according to a second embodiment will be described below. Since the basic configuration of the apparatus according to this embodiment is the same as that of the embodiment described above, an overlapping description will be omitted. Here, a configuration which is a characteristic feature of the embodiment will be described below.

Figure 7:
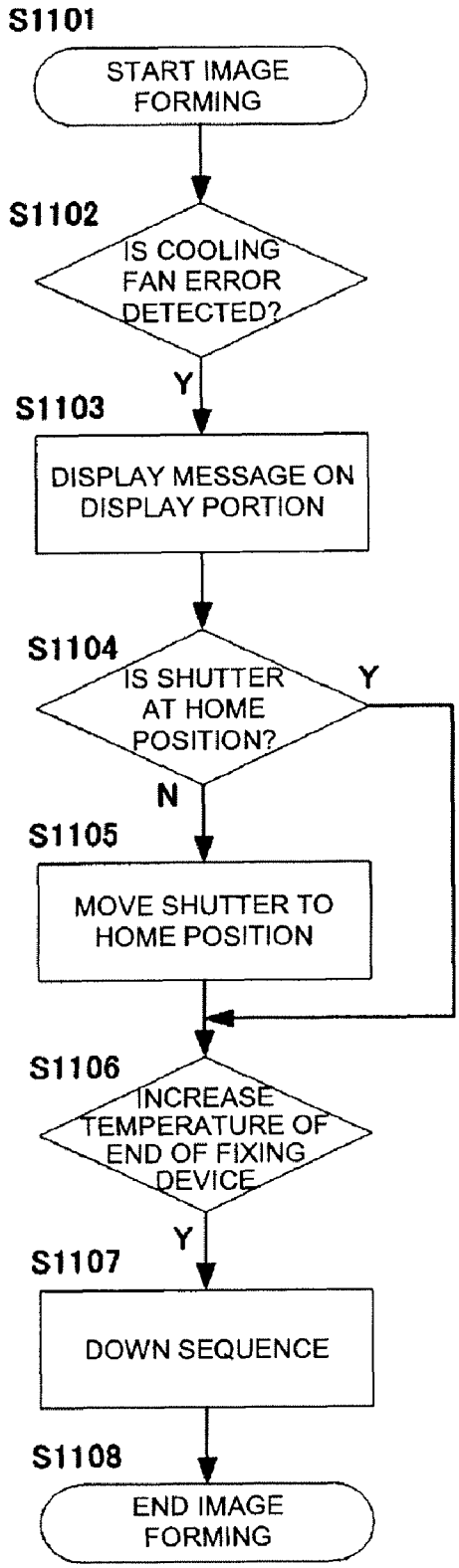
FIG. 7 is a flow chart applied when a cooling fan error occurs.

FIG. 7 shows an operation flow chart applied when an error of a cooling fan 40 in the embodiment is detected. Also in the embodiment, the same control as that in the first embodiment is performed until an increase in temperature of a non-paper-passing portion is detected in S1105.

In the embodiment, when a thermistor detects an increase in the non-paper-passing portion (S1106), a down sequence of productivity is performed (S1107).

This down sequence is a mode in which the number of recording materials passing through a fixing device per unit time is reduced. More specifically, the down sequence is to interrupt an image forming process and perform an idle operation of the fixing device to decrease the temperature of a non-paper-passing region of a fixing film. When the temperature of the non-paper-passing region of the fixing film decreases to a predetermined temperature, a printing operation is restarted.

In the embodiment, when A4-size paper is used, image formation is performed at a rate of 30 sheets/min in a state in which the non-paper-passing portion does not increase in temperature. In contrast, in the down sequence, it is assumed that productivities are gradually lowered, i.e., 10 sheets/min, 8 sheets/min, 6 sheets/min, and 4 sheets/min depending on an increase in temperature of the non-paper-passing portion. The image forming apparatus completes a requested image forming process while executing the down sequence.

Also in the embodiment, an alarm indication is displayed on a display portion when an operation error in the cooling fan 40 is detected. In this manner, an operator can be more clearly notified of the reason why the apparatus productivity is lowered by execution of the down sequence. Furthermore, upon completion of the image formation, when the next image forming operation is enabled while displaying an alarm indication, the image formation can be performed, though the performance is limited, until the cooling fan is repaired.

The down sequence may be executed depending on not only a temperature of an image heating means but also a width of a recording material.

As described above, an error such as stop of the cooling fan 40 occurs, the cooling fan 40 is shielded by a shutter 42 from heat, and image formation is continued by the down sequence. In this manner, image formation can be efficiently performed while improving usability.

Third Embodiment

An image forming apparatus according to a third embodiment will be described below. A basic configuration of the apparatus according to the embodiment is the same as that of the embodiment described above, an overlapping description will be omitted. Here, a configuration which is a characteristic feature of the embodiment will be described below.

This embodiment describes a case in which cooling fans 40 are arranged on both the sides of a recording material in the width direction as shown in FIG. 4. A characteristic feature of the embodiment is control performed when an error occurs in one of the plurality of cooling fans 40.

Figure 8:
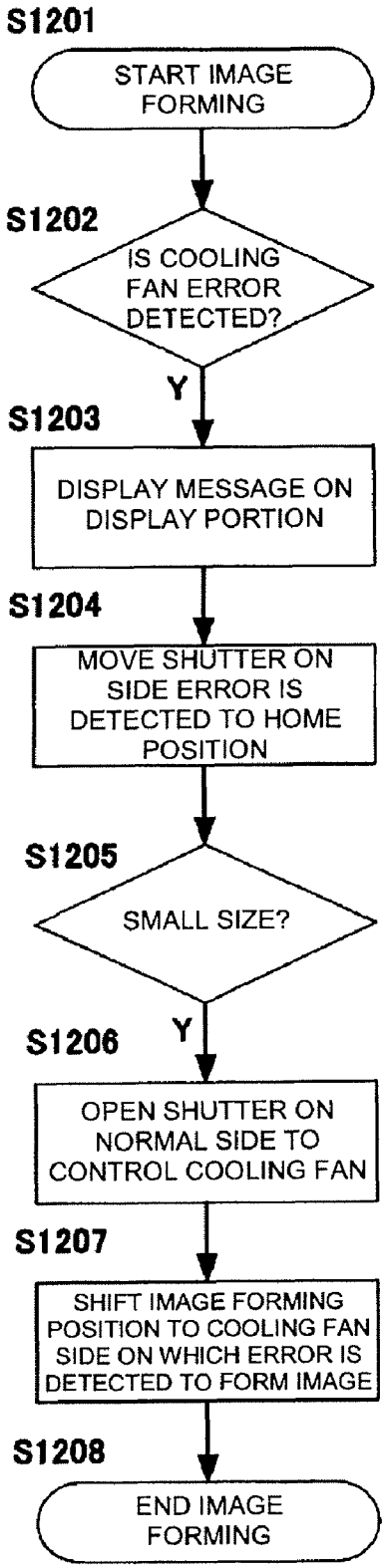
FIG. 8 is a flow chart applied when a cooling fan error occurs.

FIG. 8 shows an operation flow chart applied when an error of the cooling fan 40 in the embodiment is detected. In the embodiment, an error occurs in a cooling fan 40A (subscripts A and B are added to the cooling fans on sides A and B, respectively, hereinafter) on a side A shown in FIG. 4 (S1202), it is displayed as a message on a display portion that the error occurs in the cooling fan 40A (S1203). Only a shutter 42A on the side A is moved to a home position (S1204). When the shutter 42 on the side A is moved to the home position, an air blowing port of the cooling fan 40A on the side A is closed, and a fixing device is not adversely affected by the cooling fan 40A on the side A. For this reason, image formation can be continued regardless of the operation error in the cooling fan 40A.

Thereafter, the image formation is continuously performed. However, when a large-size recording material which uses a large portion of the width of the fixing device is used, a shutter 42B on a side B is moved to a home position, and image formation is performed while disabling both the cooling fans 40A and 40B.

On the other hand, when image formation is performed to a small-size recording material after an error of the cooling fan 40A on the side A is detected (S1205), the shutter 42B and the cooling fan 40B on the side B which normally function are controlled to prevent the cooling fan 40B of the fixing device from increasing in temperature (S1206). Furthermore, a position of an image formed on an intermediate transfer belt 8 and a position of a recording material conveyed to the fixing device are moved to the cooling fan 40 in which the error is detected to perform image formation (S1207). In this manner, image formation can be continued without using the cooling fan 40A on the side A in which the error is detected or increasing the temperature of the fixing device (S1208).

The first to third embodiments describe the example in which the two cooling fans and the two air blowing ports are arranged. However, when a recording material is conveyed with reference to one side, only one cooling and only one air blowing port may be arranged. According to need, three or more cooling fans or air blowing ports may be arranged.

Fourth Embodiment

Cooling mechanism control of a fixing device 100 according to a fourth embodiment will be described below. Since a basic configuration of the image forming apparatus is the same as that of the embodiment described above, a description thereof will be omitted.

An object of this embodiment is to prevented other portions of the apparatus from being adversely affected, and to continue an operation of the apparatus when a shutter cannot normally moved. Control performed when an error occurs in a mechanism which drives a shutter (failure occurs) will be concretely described below.

Figure 9:
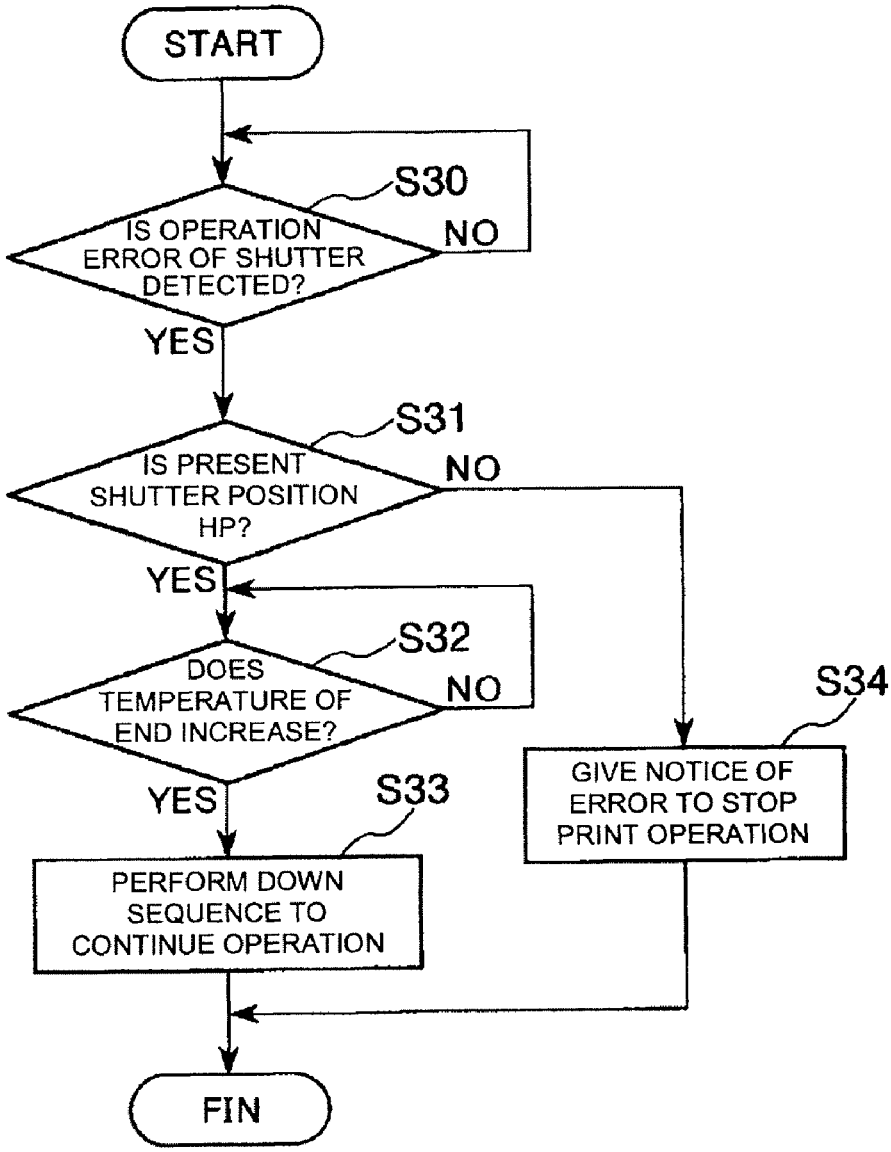
FIG. 9 is a flow chart applied when a shutter moving error occurs.

FIG. 9 is a flow chart applied when a regulating member, i.e., the shutter 42 cannot be moved.

When printing of small-size paper is performed, or a detected temperature detected by a thermistor for measuring a temperature of an end of the fixing device exceeds a predetermined temperature, the shutter 42 is moved to a predetermined position. During the movement of the shutter, the presence/absence of an error is detected (S30). An error of movement of the shutter 42, i.e., an error occurs, a control means 171 determines whether the shutter 42 at this time is located at a position where the shutter 42 shields the cooling fan 40 (S31).

In the embodiment, the position where the shutter 42 is located at the position where the shutter 42 shields cooling air from the cooling fan 40 is defined as a home position, and the following description is performed.

The control means 171 does not operate the cooling fan 40 when the position of the shutter 42 is the home position, and the CPU 171 continues the image forming operation, i.e., a printing operation without any change. Continuous printing operations and the like are performed to small-size paper. When an increase in temperature of a non-paper-passing portion is detected by an end temperature measuring thermistor, apparatus productivity is lowered to reduce a surface temperature of the non-paper-passing region to a temperature almost equal to a surface temperature of the paper-passing region, and control is performed to prolong idle operation time.

When the temperature of the non-paper-passing temperature decreases to the predetermined temperature, the printing operation is restarted (S33).

The control which lowers the apparatus productivity to prolong idle operation time and to decrease the temperature of the non-paper-passing region will be called a "down sequence" hereinafter. A detailed description of the down sequence control will be described later.

When the shutter 42 is stopped at a position except for the home position, an operator is notified that an error of shutter movement occurs, and an image forming operation is inhibited and stopped (S34). This is because, when the image forming operation is continued without shielding the cooling fan 40 by the shutter 42 and driving the cooling fan 40, the temperature of the cooling fan 40 increases, and a fan having low heat resistance may be broken down.

In this manner, according to the embodiment, when an error occurs in the moving means, a selecting means (control means) 171 selects, depending on a stop position of a regulating member, whether the subsequent image forming operation is executed.

In this embodiment, even though an error (abnormality) of movement of the shutter 42 occurs, the control described above is performed to make it possible to continue the image forming operation depending on the stop position of the shutter 42. For this reason, even though the apparatus is broken down, the image forming operation can be continued as far as possible. For this reason, an image forming apparatus having high usability can be provided.

Figure 10:
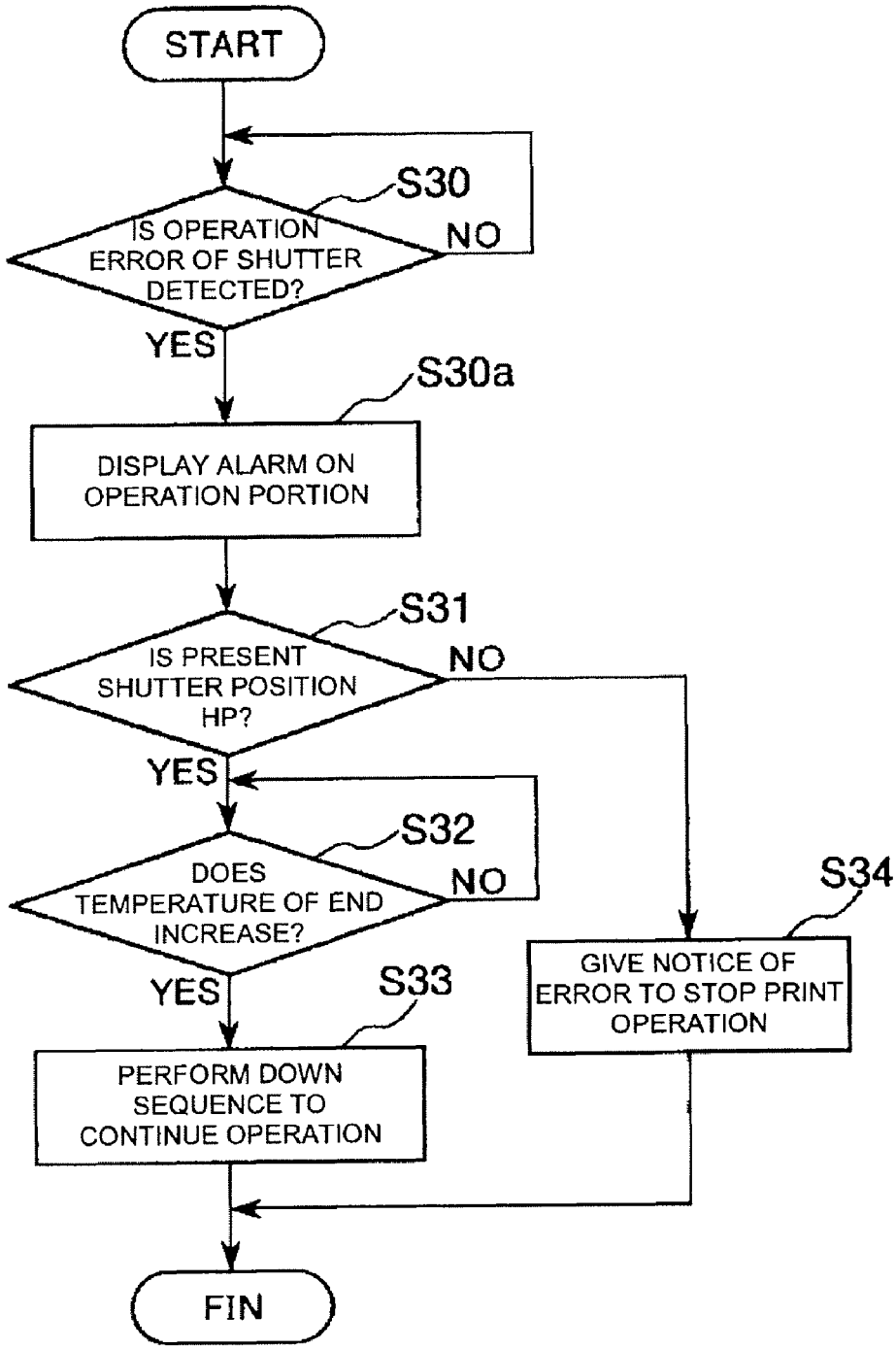
FIG. 10 is a flow chart applied when a shutter moving error occurs.

In the embodiment, when an operation error in the shutter 42 is detected (S30), as shown in an example shown in FIG. 10, an alarm can also be displayed on the operation portion 172. The subsequent operation is the same as the operation shown in FIG. 9.

Figure 11:
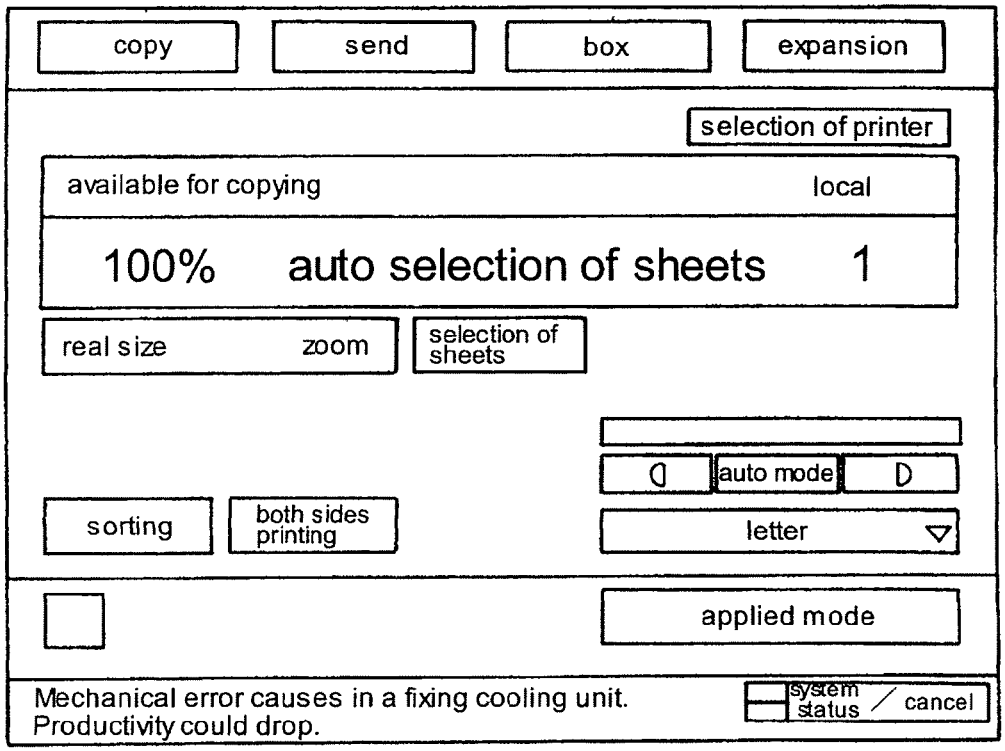
FIG. 11 is a diagram showing an example of an alarm display of an operation portion.

An example of an alarm indication on the operation portion 172 is shown in FIG. 11. The alarm indication shown in FIG. 11 is displayed to make it possible to urge a service person to repair the apparatus. Furthermore, the service person can be clearly notified of the reason why the apparatus productivity is lowered by executing the down sequence.

Figure 12:
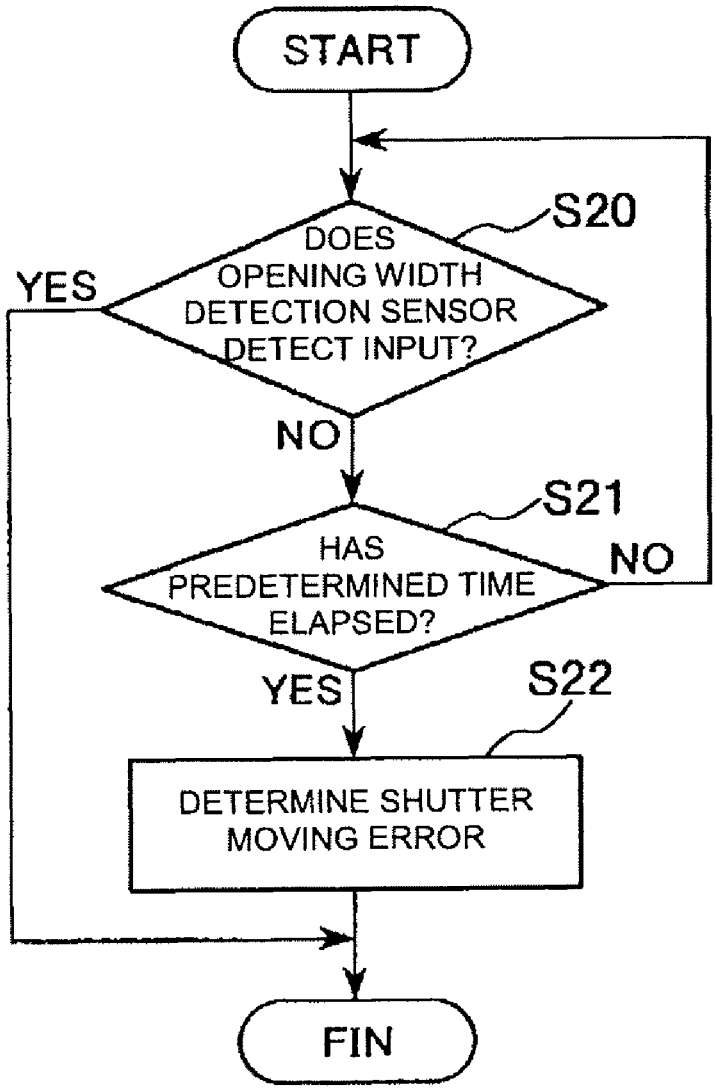
FIG. 12 is a flow chart applied when a shutter moving error is detected.

An example of an error detecting method of the movement of the shutter according to the embodiment is shown in FIG. 12.

After the shutter movement control is started, an input of the opening width detecting sensor 52 serving as a regulating member position detecting means is waited for a predetermined period of time (S20 and S21). When there is no input of the opening width detecting sensor 52 to the control means 171, the control means 171 determines that the shutter 42 does not move to determine this state as an error (abnormality).

The above error detecting method is an example. The present invention is not limited to the method. For example, in a configuration in which an error signal is generated when a drive motor Mo serving as a shutter drive source is not driven with a predetermined load, error detection can be performed by monitoring the error detection signal by the control means 171.

An example of the down sequence operation described above will be described below.

As described above, when the shutter 42 cannot be moved, and when sheets of small-size paper each having a length in a main scanning direction shorter than a maximum paper width which can pass through the apparatus are continuously caused to pass through the apparatus, it is determined depending on a detected temperature of a fixing end temperature measuring thermistor whether the down sequence is executed.

The determination of the down sequence execution is performed every sheet on which image formation is performed. When the thermistor detection temperature is higher than a predetermined value, the current productivity is lowered to a productivity one stage lower than the current productivity. An example of a table for defining productivities is shown in Table 1.

TABLE 1

| | | Down Sequence Level | | | |
|---|---|---|---|---|---|
| | Normal State | First Stage | Second Stage | Third Stage | Fourth Stage |
| Constant Rate | 30 | 10 | 8 | 6 | 4 |
| Half Rate | 15 | 4 | 4 | 4 | 2 |

According to Table 1, for example, when an image forming operation is performed with a productivity of 30 sheets/min in a normal state, and when the thermistor detection temperature exceeds a predetermined value, the productivity is lowered to a productivity of 10 sheets/min corresponding to the first stage of the down sequence level. When the mode which lowers the productivity is selected, an interval between pages increases, time for a state in which paper is not engaged with the fixing device, i.e., idle operation time is prolonged. When the idle operation time is prolonged, a temperature of the non-paper-passing region decreases, and a temperature difference between the paper-passing region and the non-paper-passing region becomes small.

After the first stage of the down sequence level is set, each time the fixing device end temperature measuring thermistor exceeds the predetermined value, the down sequence level is lowered, and, consequently, the idle operation time is prolonged to continue the image forming operation. This is an example of the down sequence operation.

At a timing of movement of a shutter, and in addition, after an error operation of movement of the shutter occurs, in determination of execution of the down sequence, the description is performed by using the non-paper-passing portion temperature as a condition for the determination. However, the present invention is not limited to the description. For example, in determination of the start of shutter movement and the down sequence execution, accumulated time from the start of an image forming operation may be used, or uniform determination may be made depending on the paper size. In the configuration in which the uniform determination is performed depending on the paper size, the down sequence may not be started when a paper size is large.

Fifth Embodiment

Figure 13:
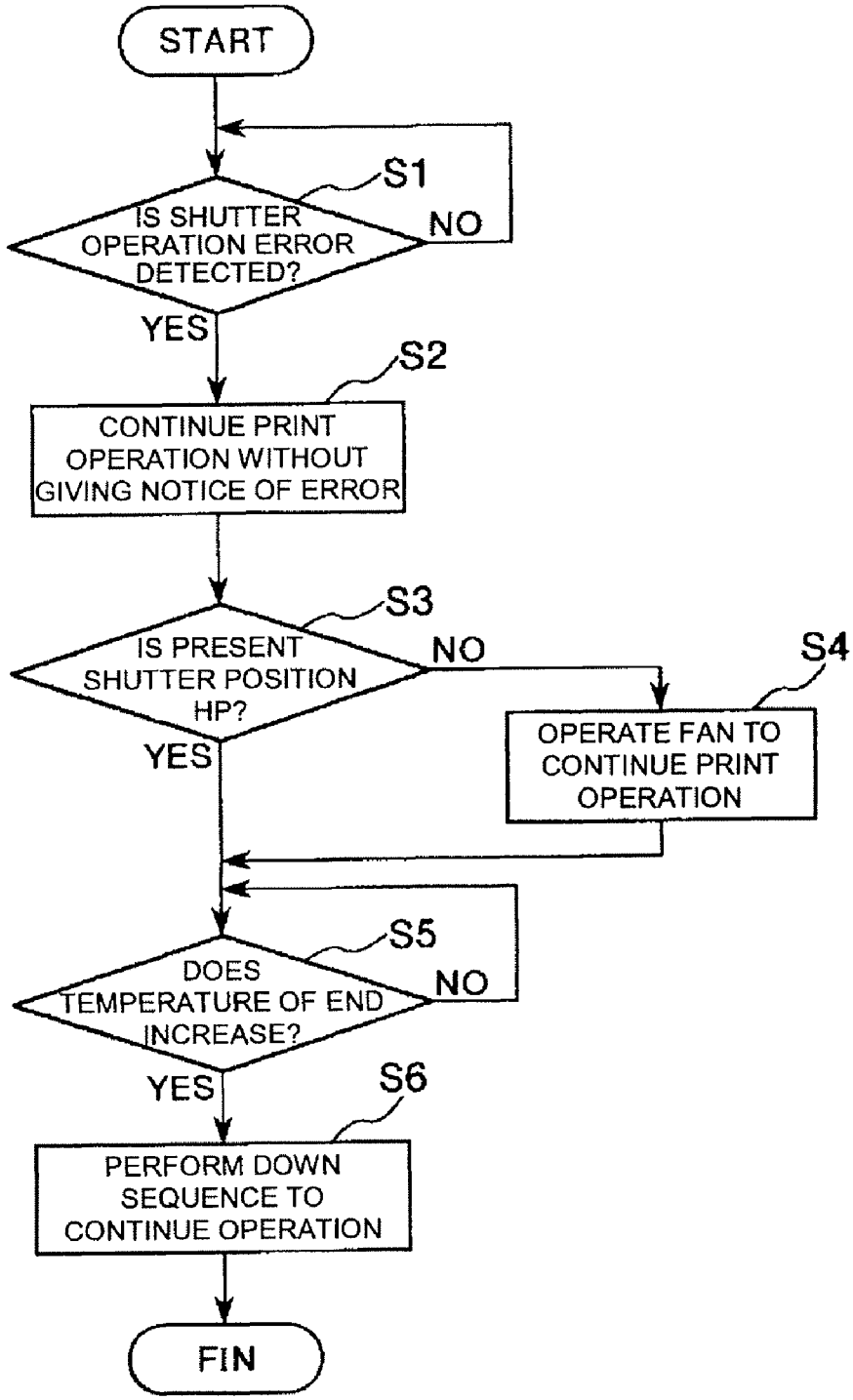
FIG. 13 is a flow chart applied when the shutter moving error occurs.

FIG. 13 shows a flow chart applied when the shutter 42 cannot be moved. Since the basic configuration of an image forming apparatus is the same as that in the embodiment, a detailed description thereof will be omitted.

In the embodiment, the following configuration will be described. That is, when the shutter 42 cannot be moved, even though a stop position of the shutter 42 is any position, image formation can be performed without stopping the apparatus.

When printing for small-size paper is performed, or when a temperature detected by an end temperature measuring thermistor exceeds a predetermined temperature, the shutter 42 is moved to a predetermined position. During the movement of the shutter, the presence/absence of an error is detected (S1). Even though an error occurs, the printing operation is continued (S2). In occurrence of an error, it is determined whether the shutter 42 at this time is at a home position (S3). When the shutter 42 is at the home position, the printing operation is continued without any change. Since the subsequent operations (S5 and S6) are the same as the operations (S32 and S33) of the example shown in FIG. 9, a description thereof will be omitted.

When the shutter 42 is stopped at a position except for the home position, a cooling fan 40 is driven to select a mode in which the printing operation is continued (S4). This is to prevent a temperature of an inexpensive fan having low heat resistance from being increased, consequently, to prevent failure.

At this time, an air flow rate of the cooling fan 40, i.e., a drive speed is set to be lower than a normal drive speed. In occurrence of a shutter movement error, the cooling fan 40 is driven to prevent a temperature of the cooling fan 40 itself from being increased. For this reason, in order to prevent cooling air from unnecessarily flowing to a fixing device 100, the cooling fan 40 is driven at a speed lower than the drive speed in the normal operation.

Alternatively, the air flow rate of the cooling fan 40 can also be changed depending on conditions such as an image forming rate, a type of paper to which image formation is performed, and a fixing device temperature. Furthermore, depending on a stop position when the shutter 42 is stopped such that the shutter 42 cannot be moved, the air flow rate of the cooling fan 40 is changed. In either case, it is an object of the control to finely adjust an air flow rate in consideration of prevention of failure of the cooling fan 40 and influence to image formation.

Upon completion of the printing operation, the operations (S5 and S6) are restarted.

In execution of the control described above, when the operation of the shutter 42 cannot be performed due to failure, even though the shutter 42 is stopped at any position, an image forming operation can be continued without enlarging a failure position.

Sixth Embodiment

Figure 14:
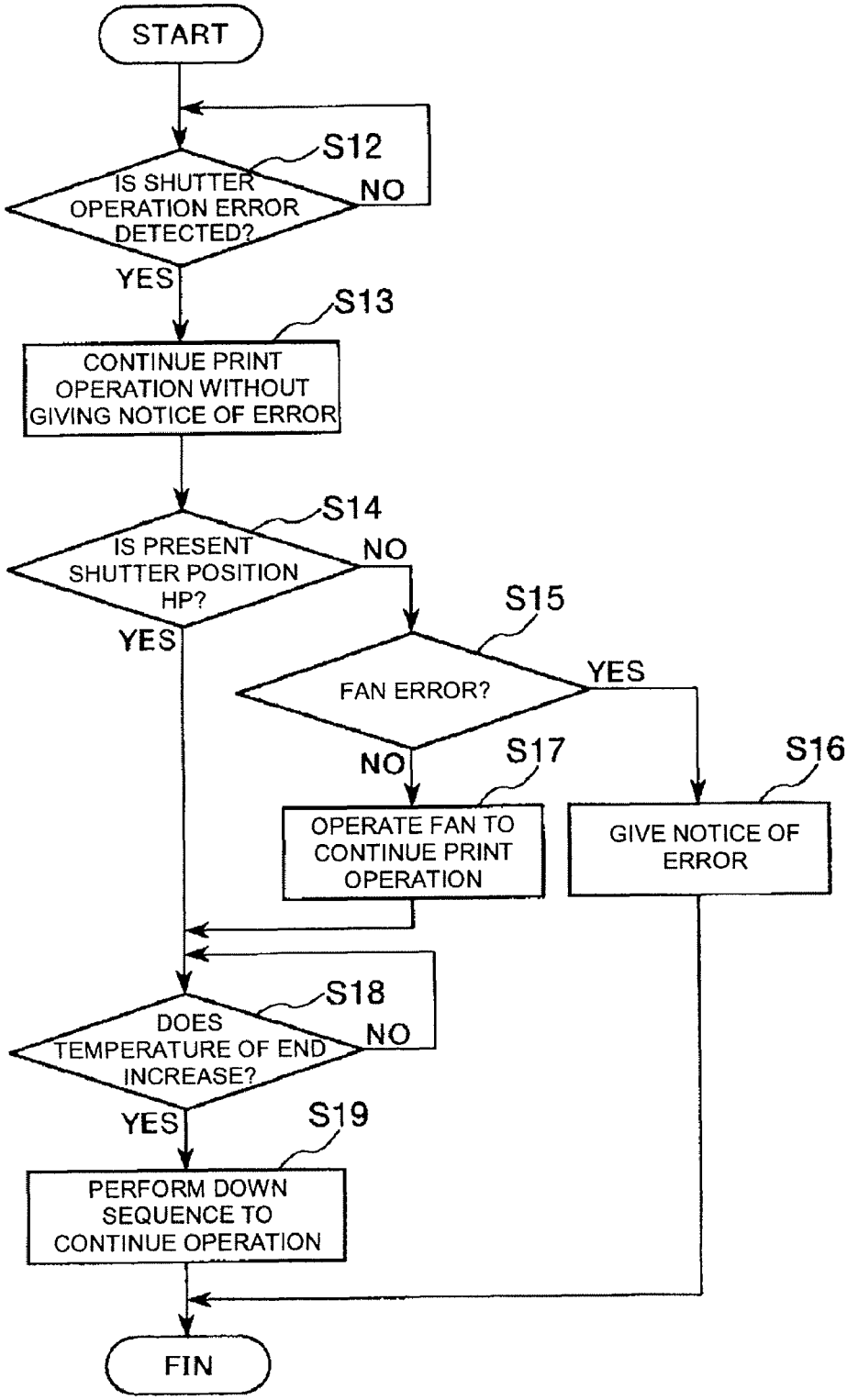
FIG. 14 is a flow chart applied when a shutter moving error and a cooling fan error occur.

FIG. 14 shows a flow chart of an embodiment in which a shutter 42 cannot be moved and an error (abnormality) occurs in a cooling fan 40. Since the basis configuration of an image forming apparatus is the same as the embodiment described above, a description thereof will be omitted.

According to the embodiment, an error of a moving operation of the shutter 42 is detected (S12). When the position of the shutter 42 is not a home position, (S14), the presence/absence of failure of the cooling fan 40 is detected (S15). When an error of the cooling fan 40 is detected, the cooling fan 40 cannot be moved, and shielding by the shutter 42 is not performed. For this reason, notification of the error is immediately performed to stop the operation of the apparatus. When there is no error of the cooling fan 40, the same operations as the operations (S5 and S6) of the example shown in FIG. 13 are performed.

When an error signal is designed to be generated when a drive motor Mf serving as a drive source is not driven with a predetermined load, failure of the cooling fan 40 can be detected as an error by a configuration in which the error detection signal is monitored by a control means 171. As an error detecting method for the cooling fan, another method such as a method of detecting an error by detecting a rotating speed of a cooling fan can be used. The present invention is not limited to the above method.

When an apparatus failure area may be extended by executing the control, the operation of the apparatus can be reliably stopped.

In the above descriptions of the embodiments, as an object to be cooled by the cooling device, the fixing device which fixes an unfixed toner image is used as an example. However, the object to be cooled is not limited to the above object. For example, as the object to be cooled by the cooling device, an image heating device which heats a toner image fixed on a sheet to increase a degree of brilliancy of the image may be used. As the image forming apparatus, an intermediate-transfer type electrophotographic full-color printer using an intermediate transfer belt is exemplified. However, the image forming apparatus is not limited to the electrophotographic full-color printer. For example, when the present invention is similarly applied to a direct-transfer type image forming apparatus which is known by a person skilled in the art and which directly transfers a toner image onto a recording material conveyed by a recording material bearing member or a black-and-white image forming apparatus, the same operations and advantages as described above can be achieved.

This application claims the benefit of priority from the prior Japanese Patent Application No. 2006-182960 filed on Jul. 3, 2006 and No. 2006-183953 filed on Jul. 3, 2006 the entire contents of which are incorporated by reference herein.

What is claimed is:

1. An image forming apparatus comprising:

an image forming device for forming a toner image to a recording material;

an image heating device for heating the toner image on the recording material;

a cooling device, which includes a fan for blowing air toward an opening and a shutter for opening and closing said opening, for cooling said image heating device by blowing the air; and a controller for permitting execution of an image heating process in a status that the shutter is closed when an error occurs in said fan during the image heating process.

2. The apparatus according to claim 1, wherein said cooling device includes first and second fans which blow the air toward first and second openings, respectively, first and second shutters which open and close said first and second openings, respectively, and a single driving device which drives said first and second shutters to open and close said first and second openings, respectively, and when an error occurs in either of said first and second fans, said controller closes said first and second shutters to permit resuming of the image heating process.

3. The apparatus according to claim 1, wherein said cooling device includes a driving device which drives said shutter to open and close said opening, and when an error occurs in said driving device, said controller permits resuming of the image heating process.

4. The apparatus according to claim 1, wherein said apparatus is operable in a mode for decreasing a number of recording materials passing through said image heating device per unit time during the image heating process.

5. The apparatus according to claim 4, wherein said cooling device is designed to cool a region on an end side in a width direction of said image heating device rather than a contact region between said image heating device and a recording material having a predetermined width, and the mode is executed when a temperature of the region on the end side in the width direction of said image heating device increases to a predetermined temperature.

6. The apparatus according to claim 1, wherein said apparatus is operable in a mode for interrupting an image forming process when a temperature of said image heating device rises a predetermined temperature during the image forming process after the error occurs in said cooling device.

7. The apparatus according to claim 1, further comprising a notification device to notify an operator that the error occurs in said fan.

8. An image forming apparatus comprising:

an image forming device for forming a toner image to a recording material;

an image heating device for heating the toner image on the recording material;

a fan for blowing an air toward an opening to cool said image heating device;

a shutter for opening and closing said opening;

a driving device for driving said shutter to open and close said opening; and a controller for controlling whether an image heating process is executed depending on a stop position of said shutter due to an error of said driving device.

9. The apparatus according to claim 8, wherein said controller inhibits the image heating process when said shutter is located at such a position that at least a part of said opening is opened, and said controller permits resuming of the image heating process when said shutter is located at such a position that said opening is closed.

10. The apparatus according to claim 8, wherein said controller operates said fan in executing the image heating process when said shutter is located at such a position that at least a part of said opening is opened.

11. The apparatus according to claim 10, wherein said controller changes an air blowing condition by said fan depending on a stop position of said shutter.

12. The apparatus according to claim 8, wherein said apparatus is operable in a mode for decreasing a number of recording materials passing through said image heating device per unit time during the image forming process when said shutter is located such a position that at least a part of said opening is opened due to the error of said driving device.

13. The apparatus according to claim 12, wherein said cooling device is designed to cool a region on an end side in a width direction of said image heating device rather than a contact region between said image heating device and a recording material having a predetermined width, and the mode is executed when a temperature of the region on the end side in the width direction of said image heating device increases to a predetermined temperature.

14. An image forming apparatus comprising:

an image forming device for forming a toner image to a recording material;

an image heating device for heating the toner image on the recording material;

a fan for blowing an air toward an opening to cool said image heating device;

a shutter for opening and closing said opening; and a driving device for driving said shutter to open and close said opening, wherein said apparatus is operable in a mode for operating said fan during which an image heating process is executed when said shutter is located at such a position that at least a part of said opening is opened due to an error of said driving device.

15. The apparatus according to claim 14, wherein, when the image heating process is executed, an air blowing condition is changed depending on a stop position of said shutter.

16. The apparatus according to claim 14, wherein said apparatus is operable in a mode for decreasing a number of recording materials passing through said image heating device per unit time during an image forming process when said shutter is located at such a position that at least a part of said opening is opened due to the error of said driving device.

17. The apparatus according to claim 16, wherein said cooling device is designed to cool a region on an end side in a width direction of said image heating device rather than a contact region between said image heating device and a recording material having a predetermined width, and the mode is executed when a temperature of the region on the end side in the width direction of said image heating device increases to a predetermined temperature.

18. The apparatus according to claim 16, wherein in the mode, the number of recording materials is changed depending on a stop position of said shutter.

* * * * *